US005398912A

United States Patent [19]

Nishi et al.

[11] Patent Number: 5,398,912

[45] Date of Patent: Mar. 21, 1995

[54] HOIST INCLUDING BRAKE COVER AND OPERATING LEVER COUPLING

[75] Inventors: Yoshio Nishi; Yasuo Wada; Haruo Kubota; Munenobu Honda; Yoshio Ueno, all of Osaka, Japan

[73] Assignee: Elephant Chain Block Company Limited, Osaka, Japan

[21] Appl. No.: 989,560

[22] Filed: Dec. 11, 1992

Related U.S. Application Data

[62] Division of Ser. No. 852,943, Mar. 17, 1992, Pat. No. 5,305,989.

[30] Foreign Application Priority Data

Dec. 2, 1991 [JP] Japan ..... 3-318040
Sep. 20, 1992 [JP] Japan ..... 3-241372

[51] Int. Cl.[6] ..... B66D 1/04

[52] U.S. Cl. ..... 254/352; 254/369

[58] Field of Search ..... 254/317, 318, 320, 321, 254/352, 355, 357, 901, 366, 369, 372, 376; 24/16 R, 270, 26, 20 R; 403/DIG. 7, 326

[56] References Cited

U.S. PATENT DOCUMENTS

| | | | |
|---|---|---|---|
| 2,165,984 | 7/1939 | Schroeder | 254/352 X |
| 3,047,114 | 7/1962 | Stevens, Jr. | 254/352 X |
| 3,298,409 | 1/1967 | Elson | 403/326 X |
| 4,065,100 | 12/1977 | Walsh | 254/167 |
| 4,183,280 | 1/1980 | Hashimoto | 403/DIG. 7 X |
| 4,468,005 | 8/1984 | Nakamura | 254/352 X |
| 4,469,308 | 9/1984 | Nakamura et al. | 254/357 X |
| 4,474,360 | 10/1984 | Maeda | 254/357 X |
| 4,483,519 | 11/1984 | Nakamura | 254/350 |
| 4,512,555 | 4/1985 | Nakamura | 254/357 X |
| 4,664,357 | 5/1987 | Nishimura | 254/903 X |
| 5,088,694 | 2/1992 | Nishimura | 254/352 |
| 5,149,058 | 9/1992 | Nishimura | 254/352 X |
| 5,156,377 | 10/1992 | Nishimura | 254/352 X |
| 5,238,226 | 8/1993 | Nishimura | 254/352 |

FOREIGN PATENT DOCUMENTS

| | | | |
|---|---|---|---|
| 0522708 | 11/1951 | Canada | 254/357 |
| 3311592 | 11/1983 | Germany . | |
| 54-9381 | 4/1979 | Japan . | |
| 63-8711 | 3/1988 | Japan . | |
| 116903 | 8/1989 | Taiwan, Prov. of China . | |

*Primary Examiner*—Clifford D. Crowder
*Assistant Examiner*—Ismael Izaguirre
*Attorney, Agent, or Firm*—Stevens, Davis, Miller & Mosher

[57] ABSTRACT

A hoist and traction machine having a load sheave, a driving shaft and a driving member which is screw-threadedly engageable with the driving shaft. An operating handle 16 has an inner plate 16*a* and a brake cover 13*a* to cover a mechanical brake. The inner plate and the brake cover both have apertures of about the same size through which passes a portion of the driving member. A sleeve 102 which is separate from the brake cover and the operating lever is received in the apertures and held in place by a flange and a retaining ring so as to facilitate easy assembly.

1 Claim, 8 Drawing Sheets

HOIST INCLUDING BRAKE COVER AND OPERATING LEVER COUPLING

This is a Divisional of application Ser. No. 07/852,943, filed Mar. 17, 1992, now U.S. Pat. No. 5,305,989, issued Apr. 26, 1994.

FIELD OF THE INVENTION

The present invention relates to a hoist and traction machine, and more particularly to a hoist and traction machine provided with; a load sheave; a driving shaft provided with a driven member and for driving the load sheave; a driving member screwable with the driving shaft; a braking pawl and a braking ratchet wheel and braking plates, which are interposed between the driving member and the driven member and constitute a mechanical brake; and driving means, such as a manual lever or the like, for driving the driving member normally or reversely.

BACKGROUND OF THE INVENTION

Conventionally, this kind of hoist traction machine is well-known which is disclosed in, for example, the Japanese Patent Pulication Gazette No. Sho 54-9381. The hoist and traction machine disclosed therein is so constructed that, as shown in FIG. 10, on a driving shaft B, in association with a load sheave A through a gear reduction mechanism, is mounted a driven member C which is non-rotatable relative to the driving shaft B, a driving member D provided at the outer periphery with teeth N is screwed with the driving shaft B, between the driven member C and the driving member D are interposed a braking ratchet wheel F engageable with a braking pawl E and braking plates G so as to construct a mechanical brake, and a lever H for driving the driving member D in the normal or reverse direction is provided at the driving member D. The lever H is operated to normally or reversely rotate the driving member D through a change-over pawl I selectively engageable with one of the teeth N, so that the mechanical brake comprising the braking ratchet wheel F, braking plates G, driving member D and driven member C, is operated, thereby enabling a chain J engaging with the load sheave A to hoist, lower or haul a load.

The hoist and traction machine constructed as above is provided with a free rotation control apparatus to be discussed below, which can quickly pull out the chain J toward the load side thereof in the no load state without operating the mechanical brake so as to elongate the chain at the load side, or can pull the same at the no-load side so as to be quickly reduced in length at the load side.

In detail, the free rotation control apparatus is provided between the driven member C and the driving member D with an elastic resistance member K for applying resistance against the movement of the driving member D toward the driven member C and adapted to produce a small gap Q between a holding member L fixed to the driving member D and a stopper M fixed to one axial end of the driving shaft B, during the rotational braking of the load sheave A. The change-over pawl I is set in the neutral position and the chain in the no-load state is pulled at the load side so that the driving shaft B rotates, but the driving member D is suppressed of the movement thereof toward the driven member C due to resistance of the elastic resistance member K. Hence, the mechanical brake does not operate and the load sheave A is freely rotatable, thereby enabling the load sheave A to be put in the free rotation state and the chain J to be quickly drawn out.

Such conventional free rotation control apparatus, which applies resistance only by the elastic resistance member K against the movement of driving member D toward the driven member C, so that, when the chain J in the no-load state is drawn in the state of disengaging the pawl I from the teeth N, if the drawing speed is too fast and the drawing force too strong, the driving member D moves toward the driven member C overcoming resistance of the elastic resistance member K and the mechanical brake operates, thereby not enabling the load sheave A to freely rotate, so that an input range of a drawing force is restricted. Accordingly, while the drawing speed, that is, a force to draw the chain J, is being adjusted, the chain J in the no-load state should be drawn without operating the mechanical brake, thereby creating the problem in that it requires skill to freely rotate the load sheave A.

SUMMARY OF THE INVENTION

In the light of the above problem, the present invention has been designed. An object thereof is to provide a hoist and traction machine which can enlarge an input range of a pulling force of the chain during the free rotation control, hold a load sheave in the free rotation state without requiring skill, perform quick pulling work of the chain, perform with ease the free rotation control, and incapacitate the free rotation control when subjected to a load, thereby being high in safety.

Another object of the present invention is to provide a hoist and traction machine which can prevent an over-load besides the above-mentioned free rotation control and use an adjusting member for adjusting a slip load at an overload preventing mechanism also as a member for holding the free rotation operation at the free rotation control, thereby enabling the number of parts to be saved and free rotation control and overload prevention to be performed.

The present invention is characterized in that the hoist and traction machine provided with the conventional mechanical brake is provided with a free rotation control apparatus constructed to incapacitate the mechanical brake and to enable the load sheave to freely rotate.

In detail, the free rotation control apparatus is provided with;

a) a stopper provided at one axial end of the driving shaft;

b) an operating handle for free rotation, which is interposed between the stopper and the driving member in relation of being axially movable across from a first position in proximity to the driving member and a second position apart from the driving member and which is not rotatable with respect to the driving shaft;

c) an elastic biasing member interposed between the stopper and the operating handle and for biasing the operating handle toward the first position in proximity to the driving member;

d) regulation means provided between the operating handle and the driving member and for regulating a relative rotation range of the driving member with respect to the driving shaft when the operating handle is put in the first position and for enabling the regulation to be released when the same is put in the second position; and e) free rotation control holding means for putting the operating handle in the second position so as to release the regulation with the regulation means, so that, when the operating handle rotates for free rotation, the driving member is subjected to a biasing force by the elastic biasing member so as to hold the free rotation by the operating handle.

The above-mentioned construction obtains the following operational effect: In detail, the operating handle is moved against the elastic biasing member toward the second position where the operating handle moves away from the driving member so as to release the regulation by the regulation means and to enable the handle to rotate normally, whereby the handle rotates to forcibly rotate the driving member so as to enable the driving member to move away from the braking plate. Accordingly, at first, it is possible to release the braking action of a mechanical brake comprising a braking ratchet wheel and braking plates. Then, the free rotation control holding means applies a biasing force of the elastic biasing member onto the driving member so as to hold the state where the braking action by the brake is released, that is, the state of free rotation. Accordingly, an input range of the pulling force of chain during the free rotation control is enlarged by the holding, thereby enabling the chain at the load side to be quickly enlongated and shortened without requiring skill. Moreover, the operating handle, which is operated to put the load sheave in the free rotataion state, can increase its ratio of radius of gyration in comparison with the case where the driving shaft is directly rotated, thereby enabling the free rotation to be performed by a light force to that extent.

Accordingly, the chain can simply be elongated or shortened toward the load side without requiring skill.

When the chain engaged with the load sheave is subjected to the load, the operating handle, even when operated for free rotation, reversely rotates by the load with respect to the driving member so as not to freely rotate the load sheave, thereby improving safety.

The present invention is also characterized in that the regulation means and free rotation control means are so constructed that the regulation means is provided with a pair of projecting portions each having regulating surfaces for regulating a relataive-rotation range of the driving member with respect to the driving shaft and with engaging projections fitted between the projecting portions to engage with the regulation surfaces respectively when the operating handle is put in the first position, and the free rotation control holding means is provided with free rotation control surfaces positioned out of the regulation range by the regulating surfaces, so that when the operating handle is put in the second position to freely rotate the load sheave, the engaging projections are adapted to come in elastic contact with the free rotation regulating surfaces respectively.

Furthermore, in the above-mentioned construction, it is preferable that regulation portions for regulating the free rotation operation range by the operating handle are provided at the front in the free rotation operation direction of operating handle.

In this case, when the driving shaft is rotated to disengage the driving member from the braking plate at the mechanical brake during the free rotation operation by the operating handle, the driving member can be regulated of relative rotation thereof with respect to the driving shaft, whereby it can be avoid that, when the chain is drawn out by being pulled at the no load side, the free rotation cannot be released even when pulled out too much. In other words, when the chain is too much pulled out, a stopper provided at the no load side of the chain abuts against the frame for the hoist and traction machine so as to restrain the chain from being further pulled out. Hence, when the chain is quickly pulled out and the stopper abuts against the frame so as to suddenly stop the rotation of driving shaft, the driving member rotates by its force of inertia in spite of stopping the driving shaft, whereby the driving member moves further away from the braking plate and the projections more intensively abut against the free rotation control surfaces resulting in incapacitation of release of free rotation, but such problem can be solved by the above-mentioned regulation portions.

In the above-mentioned construction, it is preferable that the driving shaft has a positioning portion for setting the first position for the operating handle, the first position being set in the position where the operating handle is not in contact with the driving member to be discussed below.

Besides this, the present invention also characterized by providing an overload prevention mechanism as follows:

Namely, the driving member comprises a first driving member having a boss screwable with the driving shaft and a larger diameter portion opposite to the brake plate at the mechanical brake and a second driving member supported to the boss of the first driving member relative rotatably. Onto the boss of the first driving member are supported friction plates and an elastic member and is screwably attached an adjusting member for changing a biasing force applied by the elastic member to the friction plates so as to adjust a slip load, the adjusting member being opposite to the operating handle and provided with a regulation portion for regulating the relative rotation range of the driving member with respect to the driving shaft in the first position of the operating handle and with free rotation control surfaces against which the driving handle elastically abuts so as to hold the free rotation operation of the driving shaft by the handle.

In this construction, the free rotation operation of operating handle can freely rotatably control the load sheave as mentioned above and can hold the free rotation operation, so that, when the operating handle is operated not to freely rotate the load sheave, the first driving member is screwed forwardly and backwardly with respect to the driven member to actuate the mechanical brake, and the overload prevention mechanism adjustable of the rating load by the adjusting member can be operated.

Accordingly, the overload prevention mechanism is operated to prevent overloading and also the driving shaft can be kept in the free rotation state by the free rotation operating handle without requiring skill. Moreover, the adjusting member for adjusting the slip load onto the overload prevention mechanism can be used both as parts for adjusting the rating load of overload prevention mechanism and holding the driving shaft in the free rotation state, thereby enabling the number of parts to be saved.

Also, it is preferable that the hoist and traction machine provided with the overload prevention mechanism has the following construction:

The regulation portions of the adjusting member each comprise a cutout having a pair of regulating surfaces for regulating the relative rotation range of the driving member with respect to the driving shaft, the operating handle being provided with engaging projections each entering into the cutout in the first position of the operating handle to engage with the regulating surface and coming in elastic contact with the free rotation control surface in the second position.

The present invention is further characterized in that the overload prevention mechanism is so constructed that between the boss of the first driving member and the second driving member is provided a unidirectional rotation mechanism which makes the second driving member, when rotating in the driving direction, freely rotatable with respect to the first driving member and which makes the second driving member, when rotating in the non-driving direction, integrally rotatable with the first driving member, the unidirectional rotation mechanism comprising an engaging member held to be forwardly or backwardly movable to one of the first and second driving members and an engaging groove engageable with the engaging member when rotating in the engaging direction thereof during the rotation of the second driving member in the non-driving direction, the engaging groove being provided plurally and circumferentially.

In addition, the hoist and traction machine provided with the overload prevention mechanism uses the adjusting member also as a member for holding the free rotation by the operating handle, in which the free rotation is held by bringing the projections at the operating handle in elastic contact with the free rotation control surfaces of the adjusting member, whereby there is no fear that the slip load set by the adjusting member changes by the above-mentioned holding.

These and other objects of the invention will become more apparent in the detailed description and examples which follow.

DETAILED DESCRIPTION OF THE INVENTION

At first, the first embodiment of the hoist and traction machine shown in FIGS. 1 through 5 will be described.

Figure 1:
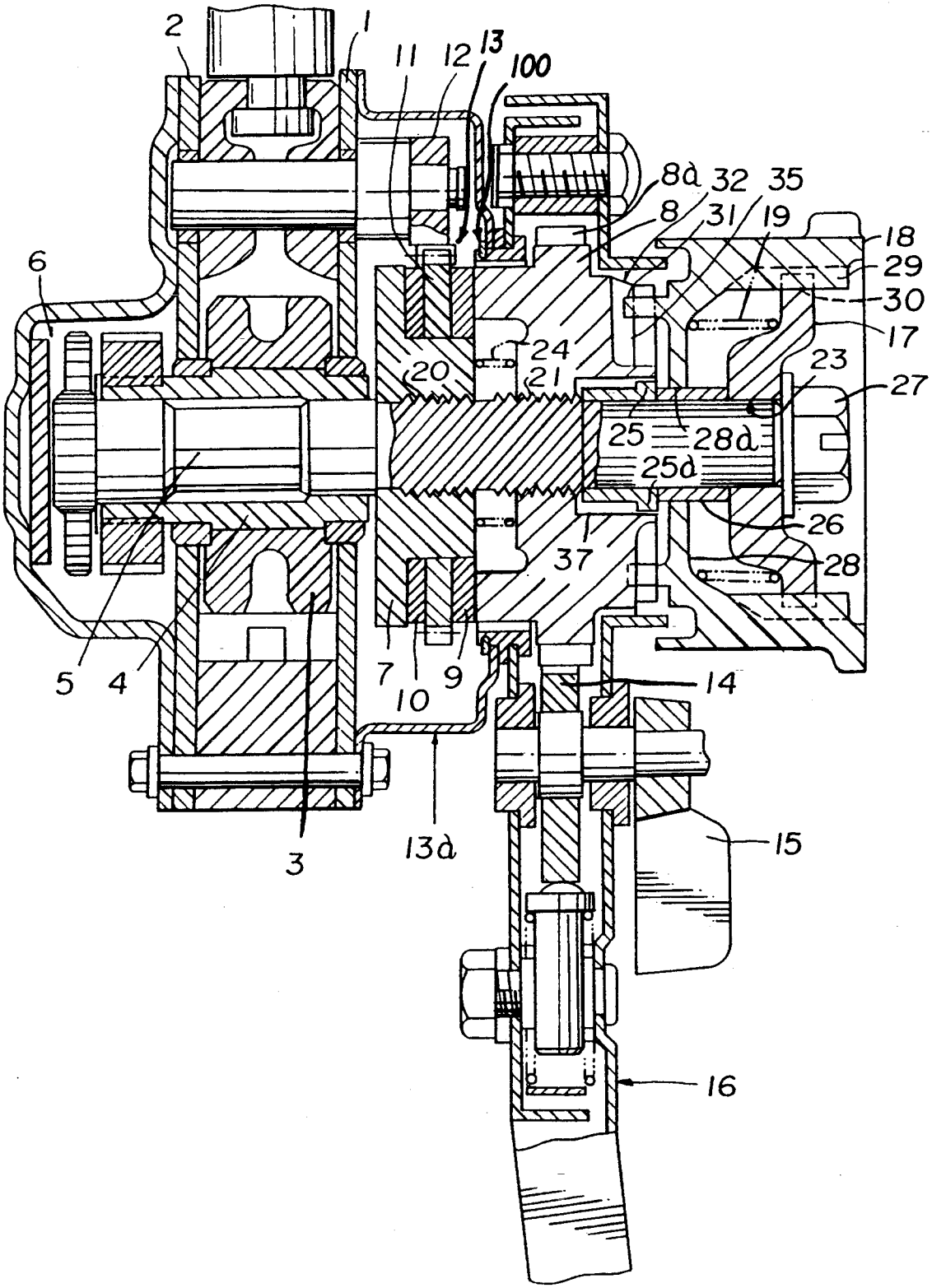
FIG. 1 is a longitudinally sectional view of a first embodiment of a lever type hoist and traction machine of the invention.

The first embodiment of the lever type hoist and traction machine, as shown in FIG. 1, is so constructed that a tubular shaft 4 having a load sheave 3 is rotatably supported between a first side plate 1 and a second side plate 2 disposed opposite to each other and spaced at a predetermined interval, in the tubular shaft 4 is relatively rotatably supported a driving shaft 5 to which a driving torque is transmitted from an operating lever to be discussed below, and a reduction gear mechanism 6 comprising a plurality of reducing gears is interposed between an outside end of a driving shaft 5 projecting from the second side plate 2 and the lead sheave 3, so that the reduction gear mechanism 6 reduces the driving torque and transmits it toward the load sheave 3.

A driven member 7 comprising a hub having a flange screws with an outer portion of the driving shaft 5 projecting from the first side plate 1, a driving member 8 having at the outer periphery thereof teeth 8*a* screws with the driving shaft 5 at the outside of the driven member 7, a pair of braking plates 9 and 10 and a braking ratchet wheel 11 are interposed between the driving member 8 and the driven member 7, and a braking pawl 12 engageable with the braking ratchet wheel 11 is provided at the first side plate 1, so that the braking ratchet wheel 11 and braking plates 9 and 10 constitute a mechanical brake 13.

Furthermore, outside a brake cover 13*a* for covering the outer periphery of the mechanical brake 13 and radially outwardly of the driving member 8 is provided driven means comprising an operating lever 16 which has a pawl member 14 provided with normal and reverse rotation pawls engageable with the teeth 8*a* provided at the outer periphery of the driving member 8 and has a central portion 15 for controlling the pawl member 14 to engage with or disengage from the teeth 8*a*. Brake cover 13*a* and operating lever 16 are rotatably coupled together via coupling mechanism 100.

Figure 11:
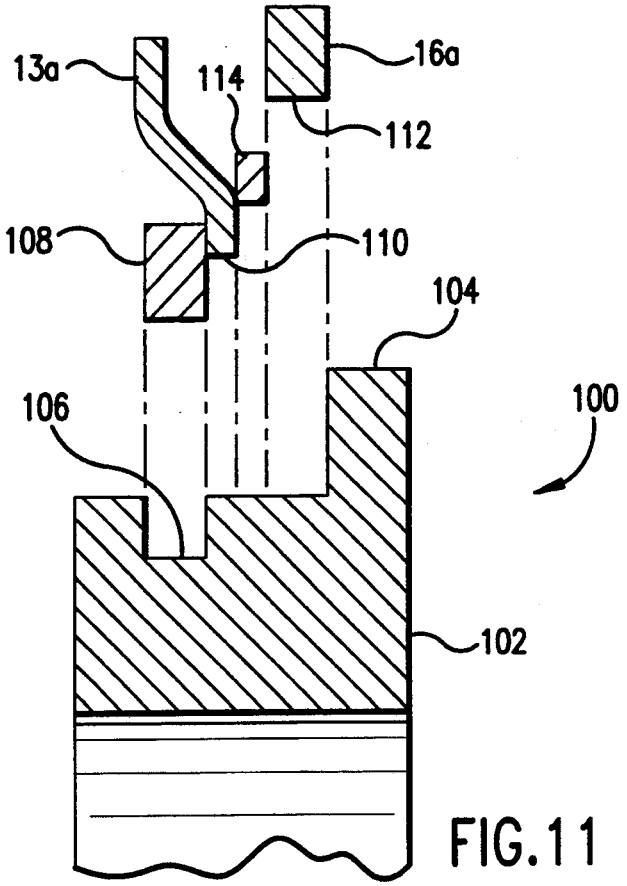
FIG. 11 is an exploded view of a portion of FIG. 1.

As shown in FIG. 1 and more particularly in FIG. 11 coupling mechanism 100 comprises a rigid sleeve 102 provided with a flange 104 at one longitudinal end thereof and a groove 106 provided at the other end for receiving a retaining ring 108, such as a snap ring. As clearly shown in FIGS. 1 and 11 the inner lip 110 of the brake cover 13*a* defines an aperture, the diameter of which is slightly larger than the outer diameter of the sleeve 102. As is clear from the figures, the inner lip 112 of the inner plate 16*a* of the operating lever also defines an aperture, the diameter of which is substantially identical to the above mentioned brake cover aperture. The brake cover 13*a* and inner plate 16*a* are rotatably connected via the sleeve 102. A spacer washer 114 is provided between them so that the brake cover 13*a* is supported against the retaining ring 108 and the spacer washer 114, while the inner plate 16*a* is supported against the flange 104 and the spacer 114.

In the lever type hoist and traction machine constructed as above a stopper 17 is provided at an axial end of the driving shaft 5, an operating handle 18 which is not rotatable to relative the driving shaft 5 is interposed between the stopper 7 and the driving member 8 in relation of being axially movable across from a first position where the handle 18 moves toward the driving member 8 to a second position where the same moves away therefrom, between the operating handle 18 and the stopper 17 is provided an elastic biasing member 19 mainly comprising a coil spring and for biasing the handle 18 toward the driving member 8, and between the operating handle 18 and the driving member 8 is provided regulation means which can regulate a relative rotation range of the driving member 8 with respect to the driving shaft 5 and release the regulation of the range by moving the handle 18 away from the driving member 8.

In other words, in the first embodiment shown in FIG. 1, first and second threaded portion 20 and 21 and a serration portion 23 are provided on the driving shaft 5, the driven member 7 screws with the first threaded portion 20 and the driving member 8 with the second threaded portion 21, a coil spring 24 is interposed between the driven member 7 and the driving member 8 and restricts the axial movement of driven member 7 with respect to the driving shaft 5, and the driving member 8 is normally rotated with respect to the driving shaft 5 so as to screw forward in the leftward direction in FIG. 1. Also, a pair of sleeves 25 and 26 are fitted onto the serration portion 23 on the driving shaft 5 axially outside of the driving member 8, a flange 25*a* is provided at the first sleeve 25, a stopper 17 is mounted by serration coupling to the end of the serration portion 23 outside the second sleeve 26, and a nut 27 is tightened to fix the stopper 17 to the driving shaft 5 through the sleeves 25 and 26.

Figure 2:
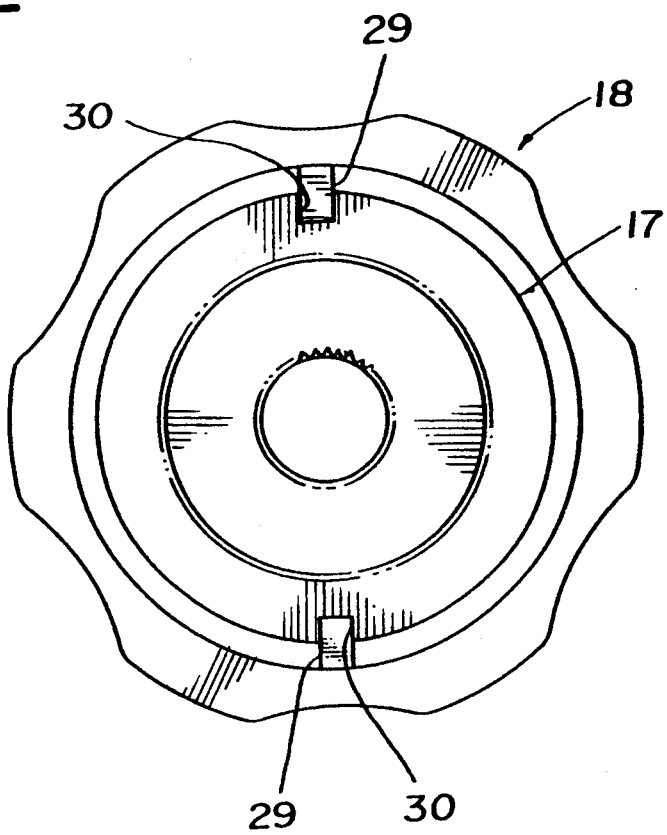
FIG. 2 is an illustration of the engaging state of ridges 29 at an operating handle with engaging grooves 30 at a stopper 17.

Onto the second sleeve 26 is fitted a bore 28*a* provided at a boss 28 of the operating handle 18, so that the operating handle 18 is interposed between the stopper 17 and the driving member 8 and, as shown in FIG. 2, a pair of ridges 29 are provided at the inner periphery of operating handle 18 so as to engage with engaging grooves 30 provided at the outer periphery of stopper 17 as shown in FIGS. 1 and 2, thereby making the operating handle 18 not rotatable with respect to the driving shaft 5.

Between the axially outside surface of the boss 28 of operating handle 18 and the axially inside surface of the stopper 17 opposite to the boss 28 is interposed the elastic biasing member 19 in contact with the respective side surfaces so as to bias the operating handle 18 toward the flange 25*a* of the first sleeve 25 in the direction of moving away from the stopper 17, in other words, toward the driving member 8.

Figure 3:
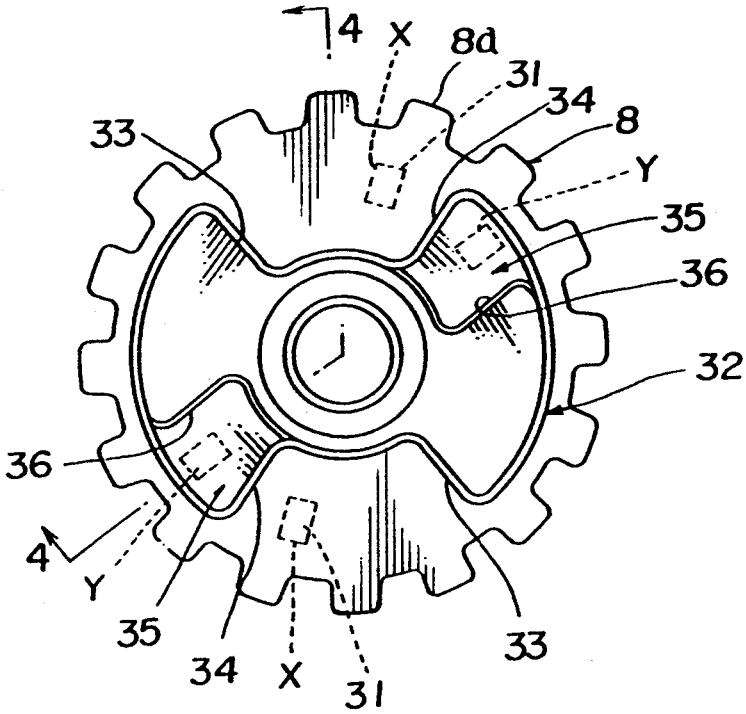
FIG. 3 is a front view of a driving member, in which a relative rotation range of the driving member with respect to a driving shaft and a rotary position of each engaging projection with respect to the driving member during the free rotation are shown.
Figure 4:
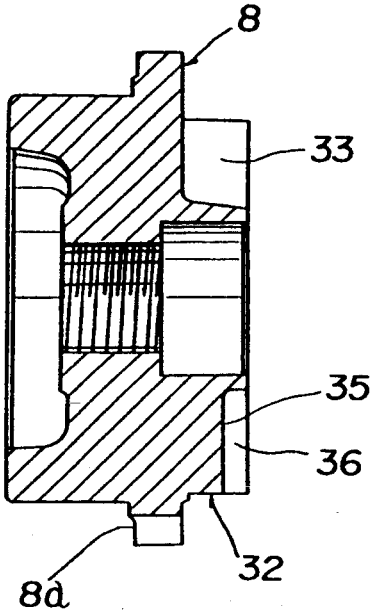
FIG. 4 is a sectional view taken on the line 4—4 in FIG. 3.

Furthermore, two engaging projections 31 projecting toward the driving member 8, are, as shown in the dotted lines in FIG. 3, symmetrically provided at the radial end portion at the rear surface of the boss 28 of operating handle 18, a pair of projecting portions 32, as shown in FIGS. 3 and 4, are symmetrically provided at one axial side of the driving member 8 opposite to the boss 28 at the operating handle 18, at the projecting side surfaces of the projecting portions 32 are provided first and second regulating surfaces 33 and 34 which, when the operating handle 18 is rotated not to axially move away from the driving member 8 but relative-rotate the driving member 8 with respect to the driving shaft 5, engage with the engaging projections 31 respectively to regulate the relative rotation range of driving member 8 with respect to the driving shaft 5, and at the projecting front surfaces of the projecting portions 32 are provided free rotation control surfaces 35 which, when the operating handle is moved away from the driving member 8 and relative rotated with respect thereto, are biased by the elastic biasing member 19, so as to be contactable with the utmost ends of engaging projections 31 respectively. Furthermore, at the projecting front surfaces of the projecting portions 32 are provided regulating portions 36 which rise from the free rotation control surfaces 35 and which when driving member 8 rotates elative to the driving shaft 5 in the state where the utmost end faces of engaging projections 31 contact with the free rotation control surfaces 35 respectively, engage with the front sides of the engaging projections 31 in the rotating direction thereof respectively.

In the above construction the driven member 7 and driving member 8 screw with the first and second threaded portions 20 and 21 on the driving shaft 5 in consideration of the workability and strength thereof, in which the first threaded portion 20 may be serrated. Also, the coil spring 24 restricts forward screwing of the driven member 7 by the driven member 7, but a snap ring, such as an E-ring, may be provided at the second threaded portion 21, or the coil spring 24 may be provided between the snap ring and the driven member 7. The screw thread of the first threaded portion 20 may be coated with nylon resin manufactured by Nylock Co. in U.S.A., having a large elastically repulsion force and a frictional coupling force so as to restrict the forward screwing of driven member 7 by the locking effect of the resin coating. Furthermore, the driven member 7 may be fixed to the driving shaft 5 by screwing a bolt or driving a cotter pin. Thus, the spring 24 is not inevitably required.

Next, explanation will be given on operation of the lever type hoist and traction machine constructed as the above-mentioned.

Firstly, for hoisting a load, the operating part 15 provided at the operating lever 16 operates to engage the feed pawl of the pawl member 14 with the teeth 8*a* of the driving member 8 and the lever 16 is operated in swinging motion, thereby normally rotating the driving member 8. The driving member 8, when normally rotating, screws forward leftwardly in FIG. 1, that is, toward the driven member 7, the mechanical brake 13 operates, and the driving torque of driving member 8 is transmitted from the driving shaft 5 to the load sheave 3 through the reduction gear mechanism 6 and tubular shaft 4, so that the hoisting work of a load connected to the chain engaging with the load sheave 3 is performed following the rotation thereof.

When the load is lowered, a reverse rotating pawl of the pawl meber 14 at the operating part 15 is engaged with one of the teeth 8*a* of the driving member 8 to swing the lever 16, thereby reversely rotating the driving member 8. Since the engaging projections 31 are put in the positions X shown by the dotted lines in FIG. 3, in other words, between the first regulating surface 33 and the second regulating surface 34, the driving member 8 rotates with respect to the driving shaft 5 between the first regulation surface 33 and the second regulation surface 34 so as to be rearwardly movable with respect to the driven member 7. Hence, the driven member 7 backwardly moves to stop braking action of mechanical brake 13 and the driving shaft 5 can reversely rotate only to an extent of reverse rotation of driving member 8, thereby performing the load lowering work in safety.

In addition, during the load hoisting or lowering work, the operating handle 18 is rotated normally or reversely without being pulled toward the stopper 17 against the elastic biasing member 19, whereby the driving member 8 is moved in the direction of operating or not-operating the mechanical brake 13 with respect to the driving shaft 5. Hence, the load sheave 3 is rotated normally or reversely only by a rotation angle corresponding to rotation of operating handle 18, thereby enabling a pulling out amount or a winding-up amount of the chain to be finely adjusted.

Next, explanation will be given on a case where the load sheave 3 is put in the free rotation state in freely extend or reduce a length of the chain toward the load.

At first, the reversing pawl of the pawl member 14 engages with one of the teeth 8*a* of driving member 8 and, when the operating handle 18 normally rotates, the driving member 8 is fixed so as to not rotate together with the operating handle 18. In this state, the operating handle is pulled out toward the stopper 17 against the elastic biasing member 19, in other words, the same is moved from the first position as shown in FIG. 1, to the second position apart from the driving member 8, thereby normally rotating the operating handle 18. At this time, while the driving member 8 cannot normally rotate because the reversing pawl the of pawl member 14 engages with the tooth 8*a* at the driving member 18, the driving shaft 5 screwing with the driving member 8 rotates together with the operating handle 18 through the stopper 17. In other words, the driving shaft 5 normally rotates with respect to the driving member 8 and in excess of the range regulated by the first and second regulating surfaces 33 and 34. Accordingly, the driving member 8 axially moves away from the driven member 7 in FIG. 1 so that the braking action by the mechanical brake 13 can be released and the load sheave 3 can be put in the free rotation state, in which the chain, when pulled toward the load side, can quickly be extended at the load side and, when pulled toward the no-load side, can quickly be shortened at the load side.

Figure 5:
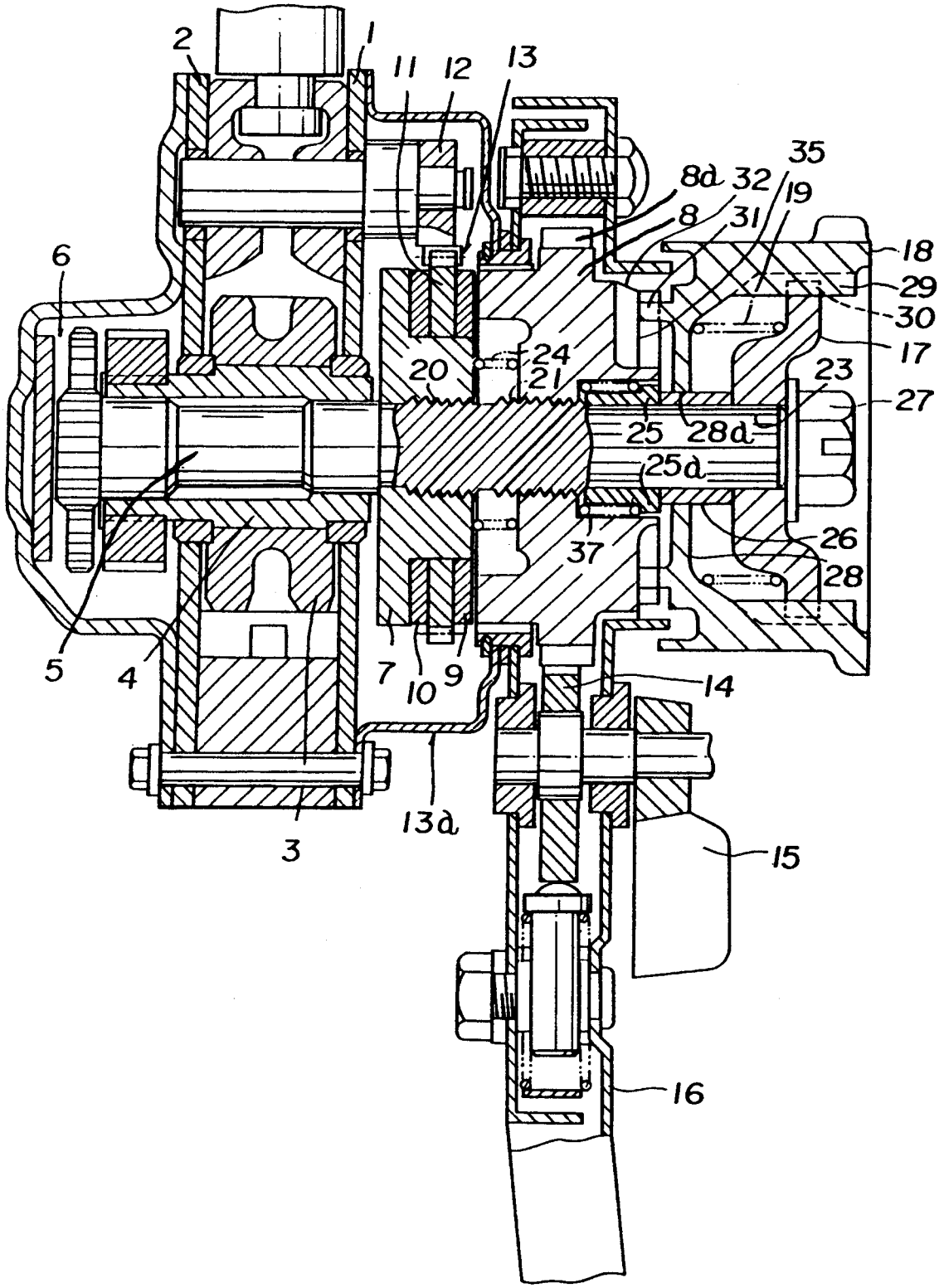
FIG. 5 is a longitudinally sectional view of the state where the hoist and traction machine is operated to freely rotate and the free rotation control is held.

As mentioned above, the operating handle 18 is pulled out and rotatably operated so that the engaging projections 31 provided at the operating handle 18 can rotatably be moved to the position Y shown by the dotted line in FIG. 3. In this state, since the operating handle 18 is biased toward the driving member 8 by the elastic biasing member 19, so that the projecting utmost ends of engaging projections 31 elastically contact with the free rotation control surfaces 35 of projecting portions 32 provided at the driving member 8 as shown in FIG. 5, whereby frictional resistance caused by the elastic contact can hold the load sheave 3 in the free rotation state. Accordingly, when the chain is adjusted by holding such the free rotation state, the input range of a pulling force of the chain can be more extended than the conventional example, whereby the chain at the load side can be pulled or contracted without requiring skill. In addition, in the first embodiment, an elastic ring 37 is interposed between the outer peripheral surface of the first sleeve 25 and the driving member 8 so that the load sheave 3 can further be easy to hold the free rotation state thereof by the relative rotation resistance of the driving member 8 with respect to the first sleeve 25.

The regulating portions 36 are provided at the projecting portions 32 provided at the driving member 8 so that, when the driving member 8 rotates with respect to the driving shaft 5 in the state where the utmost end faces of the engaging projections 31 are in elastic contact with the free rotation control surfaces 35 of the projecting portions 32, the front of each engaging projection 31 in the rotation direction thereof is regulated of its further rotation by the regulating portion 36, whereby, when the operating handle 18 is rotated with respect to the driving member 8 for freely rotating the load sheave 3, the front of each engaging projection 31 in the rotation direction thereof engages with the regulating portion 36 so as to restrict its rotational angle and an interval between the driving member 8 and the driven member 7 can be restricted not to be wider than required to freely rotate the load sheave 3. Accordingly, when the load sheave 3 freely rotates through the operating handle 18 rotating with respect to the driving member 8, the free rotation operation is performable without uselessly rotating the operating handle 18 more than required. Also, when the chain is excessively pulled toward the load and the stopper provided at the no-load end of chain engages with the side plate 1 or 2 to incapacitate further pulling of chain so as to abruptly stop the rotation of driving shaft 5, the driving member 8 rotates by its inertia force and further screws rightwardly. As the result, the utmost end faces of engaging projections 31 elastically contact further strongly with the free rotation control surfaces 35 at the projecting portions 32 in a biting manner, thereby avoiding incapacitation of release of free rotation control.

Furthermore, in the state of the free rotation control as mentioned above, when the pulling force of chain is strengthened to apply a strong force in the reverse direction onto the load sheave 3, the elastic contact of the projecting utmost end face of each engaging projection 31 with each free rotation control surface 35 is released so that each engaging projection 31 returns to between the first regulating surface 33 and the second regulating surface 34 and, as the above-mentioned, returns to the state where the mechanical brake 13 exerts or stops the braking action. In other words, during the free rotation, when the load sheave 3 is subjected to a strong force in the reverse direction, the driving member 8 screws with the driving shaft 5 and its rotary inertia force is larger than that of the driving shaft 5, whereby the free rotation control surfaces 35 slide with respect to the engaging projections 31 and the driving member 8 starts rotation somewhat later than the rotation of operating handle 18. As a result, the elastic contact of the respective projecting utmost end faces of engaging projections 31 with the free rotation control surfaces 35 is released, resulting in that each engaging projection 31 returns to between the first regulating surface 33 and the second regulating surface 34. In addition, in this case, the operating handle 18 overcomes the relative rotational resistance of the projecting utmost end faces of the engaging projections 31 with respect to the free rotation control surfaces 35 and the relative rotational resistance by the elastic ring 37, thereby rotating in the reverse rotation direction with respect to the driving resistance 8. Hence, an input range of the pulling force for the chain during the free rotation control is widened so that the free rotation control is performable without requiring skill.

When the chain engaging with the load sheave 3 is subjected to a load and the load sheave 3 is applied with the load in reverse rotation, even though the operating handle 18 is operated to carry out free rotation, the operating handle 18 together with the driving shaft 5 rotates in the reverse rotation direction by the above-mentioned load, so that the elastic contact of the utmost end faces of the engaging projectin 31 with the free rotation control surfaces 35 is released, thereby returning to the state where the mechanical brake 13 exerts or stops the braking action. Accordingly, the load sheave 3 cannot be put in the free rotation state, thereby improving safety.

Next, explanation will be given on a second embodiment of the invention shown in FIGS. 6 through 9.

The second embodiment assembles an overload prevention mechanism in the first embodiment, and is similar in the fundamental construction to the first embodiment. Accordingly, the constitution in common with the first embodiment is omitted of its description and the common components are designated with the same reference numerals.

Figure 6:
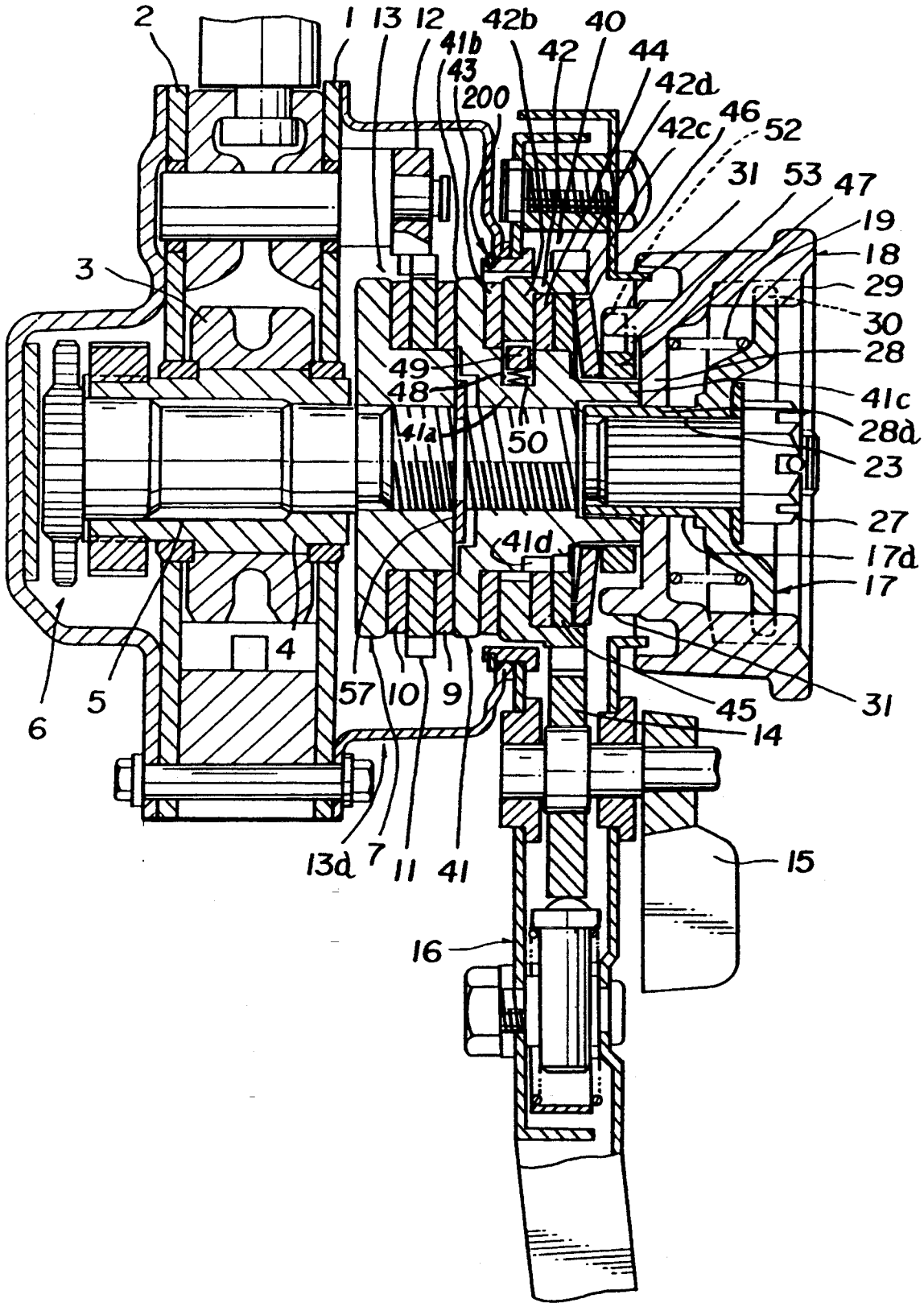
FIG. 6 is a longitudinally sectional view of a second embodiment of the lever type hoist and traction machine of the invention.
Figure 12:
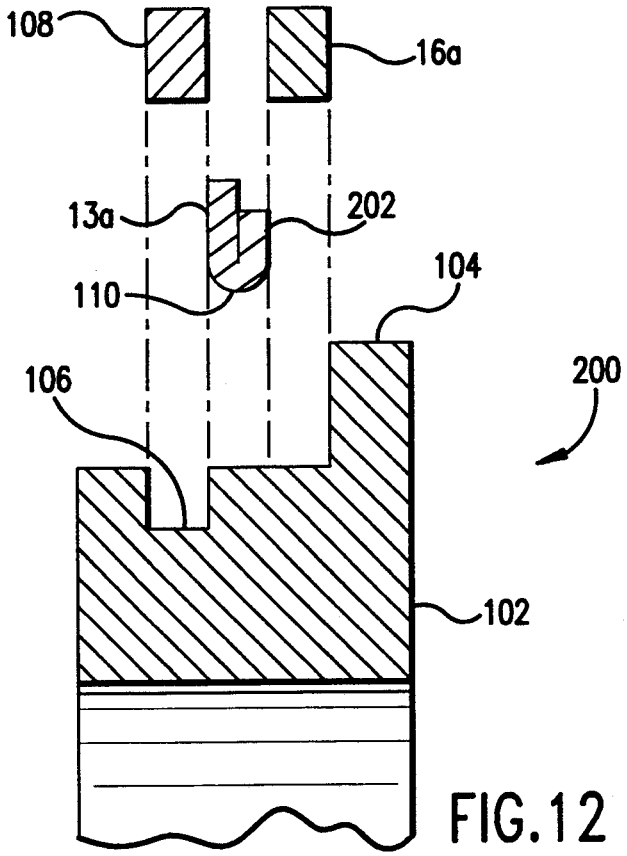
FIG. 12 is an exploded view of a portion of FIG. 6.

Referring to FIGS. 6 and 12, it is shown that the brake cover 13*a* and the inner plate 16*a* of the operating lever 16 are rotatably connected via coupling mechanism 200. This coupling is similar to the coupling 100 of the first embodiment except that the inner lip 110 of the brake cover 13*a* is bent over to form a double-structured bearing portion 202 which serves the purposes of the spacer washer 114 (see FIG. 11) of the first embodiment.

In the second embodiment, the driving member 8 in the first embodiment comprises a first driving member 41 having a boss 41*a* screwable with a driving shaft 5 and a larger diameter portion 41*b* opposite to a braking plate 9 of the mechanical brake 13 and a second driving member 42 rotatably supported onto the outer periphery of the boss 41*a*, and at the outer periphery of the second driving member 42 are provided teeth 42*a* engageable with a pawl member 14 provided at the operating lever 16.

At the boss 41*a* of the first driving member 41 are disposed a pair of friction plates 43 and 44 in a manner of longitudinally sandwiching the second driving member 42 therebetween, an elastic member 46 a disc-spring construction is disposed outside one friction plate 44 through a holding plate 45, and an adjusting member 47, for changing a biasing force of the elastic member 46 to the friction plates 43 and 46 and for adjusting a slip load, screws with the boss 41*a* outside the elastic member 46, thereby constituting the overload prevention mechanism 40.

In detail, the first driving member 41 is provided at one axial end of the boss 41*a* with the larger diameter portion 41*b* having a biasing surface opposite to the braking plate 9 and at the other axial end of boss 41*a* with a smaller diameter portion 41*c* having a screw thread at the outer periphery, and the elastic member 46 is free fitted onto the smaller diameter portion 41*c* and the adjusting member 47 screws therewith. A locking groove 41*d* for the holding plate 45 is provided at the outer periphery of the boss 41*a* and a projection projecting from the inner periphery of the holding plate 45 is fitted into the groove 41*d*, the holding plate 45 being supported to the boss 41*a* so as to be axially movable but not rotatable relative to boss 41*a*.

The second driving member 42 comprises a cylindrical member 42*c* having a vertical portion 42*b* and teeth 42*a*. The vertical portion 42*b* is rotatably supported at the inner periphery thereof on the boss 41*a*. Between the inner periphery of the vertical portion 42*b* and the outer periphery of the boss 41*a* is provided a unidirectional rotation mechanism which, when the second driving member 42 rotates in the driving direction, makes the second driving member 42 freely rotatable with respect to the first driving member 41 and, when rotating in the non-driving direction, makes second driving member 42 rotatable integrally with the first driving member 41.

Figure 9:
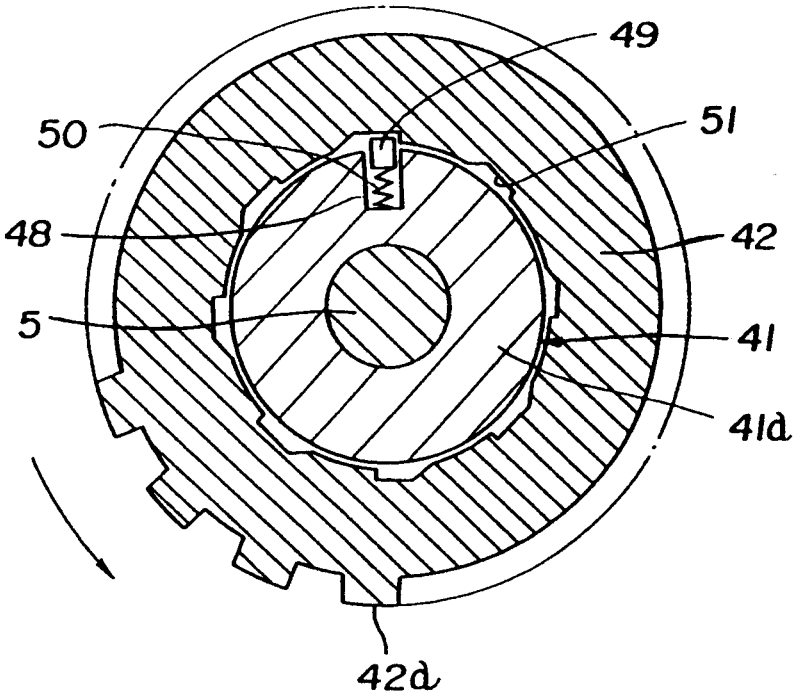
FIG. 9 is an illustration of a unidirectional rotation mechanism provided between a first driving member and a second driving member.
Figure 10:
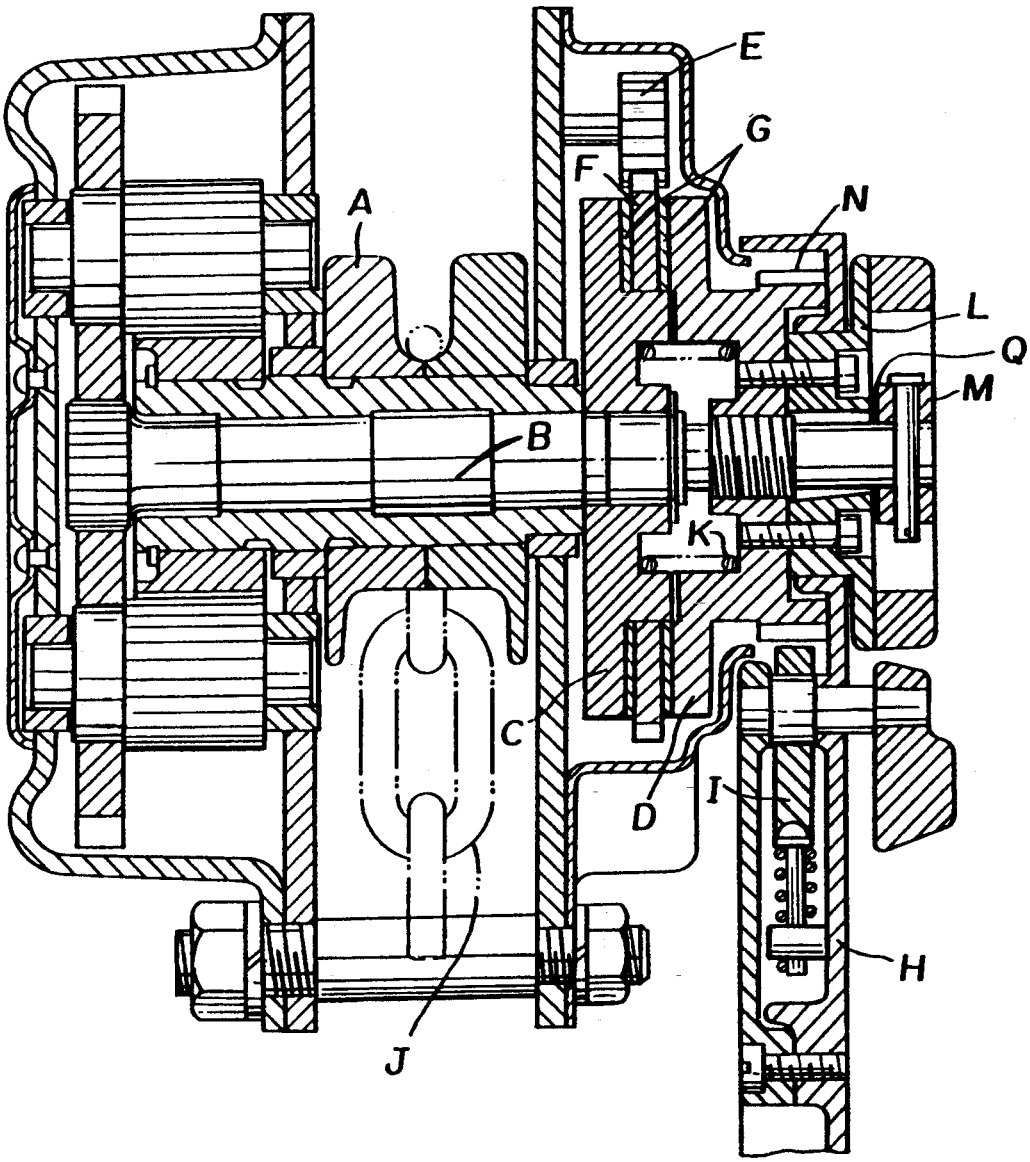
PRIOR ART Fig. 10
FIG. 10 is a sectional view of the conventional example.

The the unidirectional rotation mechanism, as shown in FIG. 9, is so constructed that a recess 48 is formed at the outer periphery of the boss 41*a* at the first driving member 41, an engaging member 49 is held in the recess 48 in relation of being biased always radially outwardly of the boss 41*a* through a spring 50, and at the inner periphery of the second drivig member 42 are formed a plurality (eight in FIG. 9) of engaging grooves which each allow the engaging member 49 to enter therein and extends circumferentialy in a wedge-like manner, so that when the second driving member 42 is rotated in the chain lowering direction as shown by the arrow in FIG. 9, the engaging member 49 engages with one of the engaging grooves 51 at an angle of at least 45° or more and the second driving member 42 and the first driving member 41 are combined with each other to be integrally rotatable, thereby coping with the case where a torque larger than a transmitting torque of the overload prevention mechanism 40 during the lowering the chain is required.

The second embodiment of the invention constructed as mentioned above assembles therein the overload prevention mechanism 40 and also a free rotation control apparatus similarly as the first embodiment. The free rotation control apparatus is not different from that in the first embodiment, thereby omitting description thereof. The adjusting member 47 of the overload prevention mechanism 40 is disposed opposite to the operating handle 18 at the free rotation control apparatus.

Figure 8:
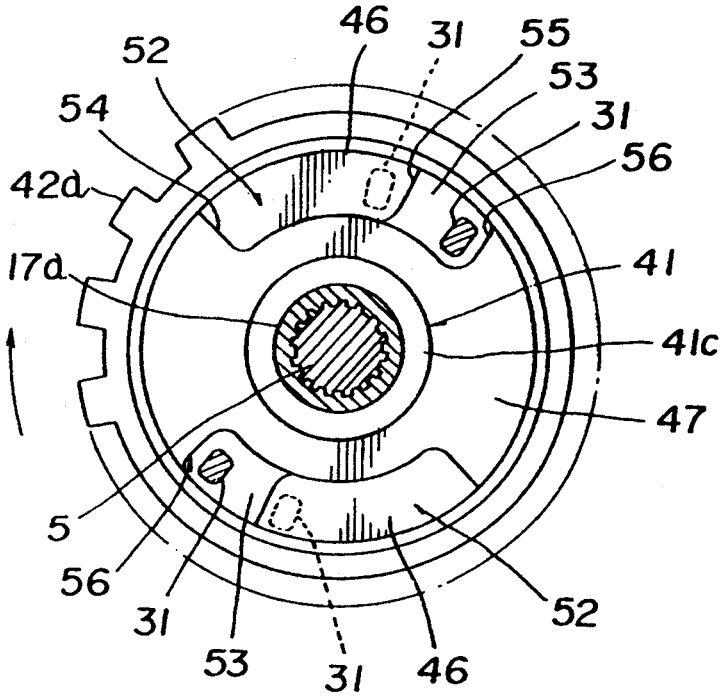
FIG. 8 is a sectional view taken on the line 8—8 in FIG. 7.

At the adjusting member 47 are provided regulation portions 52 for regulating a relative rotation range of the first driving member 41 with respect to the driving shaft 5 in the first position of the operating handle 18, and free rotation control surfaces 53 which come in elastic contact with the engaging projections 31 provided at the operating handle 18, apply resistance to the rotation of the first driving member 41 with respect to the driving shaft 5, and hold the free rotation of the driving shaft 5 by the operating handle 18, so that the adjusting member 47 may adjust a slip load and also hold the free rotation control at the overload prevention mechanism 40. In greater detail of the adjusting member 47, the regulation portions 52, as shown in FIGS. 6 and 8, are symmetrically cut out at the outer periphery and regulating surfaces 54 and 55 are formed at both circumferential sides of each cutout, so that when the operating handle 18 is not operated, in other words, in the first position, each engaging projection 31 at the operating handle 18, as the same as the first embodiment, enters into the cutout to engage with the regulating surface 54 or 55, thereby regulating the relative rotation range of the first driving member 41 with respect to the driving shaft 5. Accordingly, within the relative rotation range, the first driving member 41 can screw forward or backward with respect to the braking plate 9 and the mechanical brake 13 operates to allow the driving shaft 5 to rotate following the rotations of the first and second driving members 41 and 42, thereby enabling the load to be hoisted, lowered, hauled, or traction-released.

On the opposite surface of the adjusting member 47 to the operations handle 18 and at the front in the normal rotation direction with respect to the regulation portions 52 as shown by the arrow in FIG. 8 are symmetrically provided the free rotation control surfaces 53 in elastic contact with the utmost end faces of engaging projections 31 in the second position of the operating handle 18 respectively, the elastic contact of the engaging projections 31 with the free rotation control surfaces 53 applies resistance to the rotation of the first driving member 41 through the adjusting member 47, thereby enabling the free rotation opertion by the operating handle 18 to be held.

Figure 7:
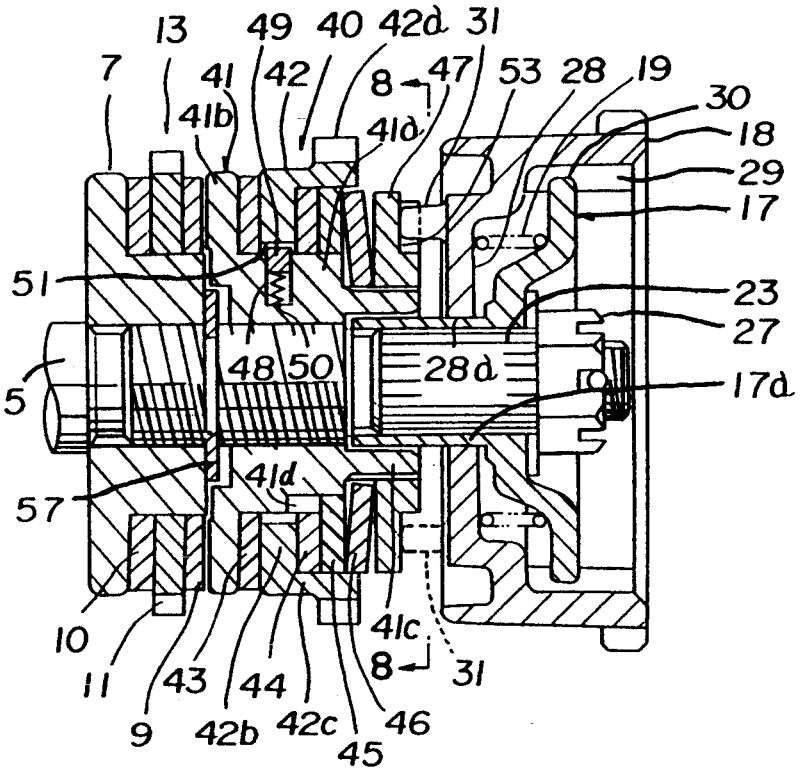
FIG. 7 is a sectional view of the principal portion of the invention, showing the state where the machine is freely rotated and the free rotation control is held, corresponding to FIG. 6.

Also, in this case, the second driving member 42, as the same as the first embodiment, is fixed through the pawl member 14 at the lever 16, and then the operating handle 18 is drawn out toward the stopper 17, and rotated with respect to the first and second driving member's 41 and 42, whereby the driving shaft 5 rotates integrally therewith. Hence, the first driving member 41, screwable with the driving shaft 5, screws backwardly from the braking plate 9, whereby the driving shaft 5 can be put in the free rotation state, at which time the utmost end faces of prejections 31, as shown in FIGS. 7 and 8, come into elastic contact with the free rotation control surfaces 53 respectively, whereby the first driving member 41 can be restrained from the relative rotation thereof with respect to the driving shaft 5 and the free rotation state of the driving shaft 5 can be held by the restraint.

In adittion, in the second embodiment, as shown in FIG. 8, free rotation regulating portions 56 are provided which, when the operating handle 18 is rotated with respect to the first and second driving members 41 and 42, prevent the operating handle 18 from rotating by contact of each projection 31 more than required.

Other than the construction of assembling an overload prevention mechanism 40, the second embodiment is different from the first embodiment in the following points: At first, the stopper 17 integrally formed at its center with a cylindrical member 17*a* serration-coupled with serrations 20 at the driving shaft 5, and the sleeve 25 in the first embodiment are omitted.

Also, the flange 25*a* at the sleeve 25 of the first embodiment is not provided at the cylindrical member 17*a*, whereby the operating handle 18 is biased by the elastic biasing member 19 so as to bring the handle 18 into elastic contact with the end face of a smaller diameter portion 41*e* at the first driving member 41.

Furthermore, a driven member 7 screws with the driving shaft 5 and is restrained by use of a snap ring 57 from its axial movement.

Next, explanation will be given on operation of the second embodiment constructed as the above-mentioned.

At first, for the hoisting or traction of load, the feed pawl at the pawl member 14 provided at the operating lever 16 engages with tooth 42*a* at the second driving member 42 by operating the control portion 15 so as to swing the lever 16, whereby the second driving member 42 is rotated and the first driving member 41 together therewith is normally rotated through the overload prevention mechanism 40. In this case, since the projections 31, as shown by the dotted lines in FIG. 8, are positioned at the regulation portions 52 and between the regulating surfaces 54 and 55, the first driving member 41, when normally rotating, screws toward the braking plate 9 and the mechanical brake 13 operates. A driving torque of the second driving member 42 is transmitted to the first driving member 41 through the overload prevention mechanism 40, and to the driving shaft 5 through the mechanical brake 13, and also transmitted from the driving shaft 5 to the load sheave 3 through the reduction gear mechanism 6 and tubular shaft 4, thereby enabling the hoisting or traction of load. In this state, when the load sheave 3 is subjected to a load larger than the rating load adjusted by the adjusting member 47, the overload prevention mechanism 40 slips to eliminate power transmission to the first driving member 41, thereby enabling the hoisting or the traction over the rating to be regulated.

In a case where the chain lowering or the release of traction is performed, the reverse rotation pawl at the pawl member 14 engages with one of the teeth 42*a* of the second driving member 42 so as to swing the lever 16, whereby the first driving member 4 is reversely and integrally rotated with the second driving member 42 through a unidirectional rotation mechanism. In this case, since the projections 31 are positioned at the regulation portions 52, the first driving member 41 rotates with respect to the driving shaft 5 to be backwardly screwable with respect to the braking plate 9, so that the driving shaft 5 can be rotated at a predetermined angle until the mechanical brake 13 operates, thereby enabling the hoisting or traction of the chain.

In this case, the lever 16 is operated in swinging motion to rotate the first and second driving members 41 and 42 in the non driving direction, that is, to revrsely rotate them, thereby reversely rotating the first driving member 41. As shown in FIG. 9, at the inner periphery of the second driving member 42, a plurality of the engaging grooves 51 engageable with the engaging member 9 are provided spaced at equal intervals, so that the engaging member 49 engages with one engaging groove 51 at an angle of at least 45° and without the need of once rotating the second driving member 42, thereby enabling the second driving member 42 to be integral with the first driving member 41 and to quickly start the lowering of the chain or the release of traction to that extent.

Next, explanation will be given on a case where the driving shaft 5 is put in the free rotation state so as to carry out free extension or contraction of the chain at the load side.

Such operation, as the same as the first embodiment, is carried out in such a manner that the reverse rotation pawl of the pawl member 14 engages with the teeth 42*a* of the second driving member 42 and, when the operating handle 18 normally rotates, the second driving member 42 is made non rotatable together with the operating handle 18, and then the operating handle 18 is pulled toward the stopper 17 against the elastic biasing member 19 and normally rotated. At this time, although the second driving member 42, whose tooth 42*a* engages with the reverse rotation pawl of the pawl member 14, cannot normally rotate, the driving shaft 5 together with the operating handle 18 is rotated in the normal direction through the stopper 17 in excess of the ranges regulated by the regulation portions 52. The first driving member 41 is moved, by the relative rotation, away from the braking plate 9, that is, rightwardly in FIG. 6, whereby the braking action by the mechanical brake 13 can be released to put the driving shaft 5 in the free rotation state. The elastic biasing member 19 biases the projecting utmost end faces of the projections 31 to come into elastic contact with the free rotation control surfaces 53 at the adjusting member 47 as shown in FIGS. 7 and 8, whereby the operating handle 18 can be restricted from its relative rotation with respect to the first and second driving members 41 and 42. Hence, it is possible to keep the driving shaft 5 in the free rotation state. Accordingly, the chain, when pulled to the load side in this state, can quickly be extended and, when pulled to the no-load side, can quickly be contracted.

In addition, during the free rotation of driving shaft 5, the projections 31 come into elastic contact with the free rotation control surfaces 53, but the adjusting member 47 does not rotate to axially move by this elastic contact and does not change the rating load on which the overload prevention mechanism 40 starts its operation. In other words, since the adjusting member 47 is subjected to the reaction force of the elastic member 46, the rotational resistance of adjusting member 47 is larger than that when the operating handle 18 in elastic contact at the projections 31 thereof with the free rotation control surfaces 53 rotates with respect to the first driving member 41, whereby the adjusting member 47 neber rotates by a torque transmitted thereto through the projections 31. Accordingly, a slip load of the overload prevention mechanism 40 preadjusted by the adjusting member 47 never changes.

Furthermore, in the state where the driving shaft 5 is held in the free rotation state as the above-mentioned, when a pulling force of the chain is strengtened to apply to the driving shaft 5 a strong force in the reverse rotation direction, the elastic contact of the respective utmost end faces of the projections 31 with respect to the respective free rotation control surfaces 53 is released, whereby the projections 31 return to the regulating portions 52 so as to return to the state where the mechanical brake 13 can operate.

As mentioned above, the second embodiment, when the operating handle 18 is not operated in free-rotation, this allows the first driving member 41 to screw forward and backward with respect to the braking plate 9 so as to operate the mechanical brake 13, whereby the hoisting, lowering, traction of the load, and release of traction are performable and also the overload prevention mechanism 40 is simultaneously performable. Moreover, the operating handle 18, when freely rotating, is rotated with respect to the first and second driving members 41 and 42 as the same as the first embodiment and the projections 31 at the operating handle 18 are brought into elastic contact with the free rotation control surfaces 53 to enable the free rotation of the driving shaft 5 to be held.

Accordingly, the overload prevention mechanism 40 can operate to perform the overload prevention and also the free rotation operating handle 18 can hold the driving shaft 5 in the free rotation state without requiring skill. Moreover, the adjusting member 47 is used not only as part for adjusting the rating load of the overload prevention mechanism 40, but also as part for holding the driving shaft 5 in the free rotation state, thereby saving the number of parts to that extent.

In addition, in the above-mentioned second embodiment, as shown in FIG. 9, the engaging member 49 is held in the recess 48 at the outer periphery of the boss 41*a* of the first driving member 41 and the engaging grooves 51 are provided at the inner periphery of the second driving member 42, but the engaging member 49 may be held at the second driving member 42 and a plurality of engaging grooves may be provided at the outer periphery of the boss 41*a*.

As seen from the above, the hoist and traction machine of the present invention can release the braking action of the mechanical brake and perform the free rotation control by the free rotation operation that the operating handle 18 is moved away from the driving member 8 against the elastic biasing member 19 and normally rotated, and also can hold the state of releasing the braking action of the mechanical brake, in brief, the free rotation control by being biased by the elastic biasing member 19. Accordingly, the input range of pulling force of chain during the free rotation control is expanded to ensure free rotation control without requiring skill. Moreover, since the operating handle 18 is adapted to operate to put the load sheave 3 in the free rotation state, the operating handle 18 can enlarge a ratio of radius of gyration of its rotation operation and perform the free rotation with a light force in comparison with the direct rotation of the driving shaft 5.

Accordingly, free extension or contraction of the chain with respect to the load side can simply be carried out without requiring skill.

When the chain engaged with the load sheave 3 is subjected to the load, even though the free rotation operation is intended to be performed, the free rotation state cannot be held, thereby raising the safety. Also, as described in the second embodiment, the hoist and traction machine assembling therein the overload prevention mechanism 40 can perform the overload prevention by operating the overload prevention mechanism 40 and also can operate the operating handle 18 to hold the driving shaft 5 in the free rotation state without requiring skill. Moreover, the adjusting member 47 is used not only as part for adjusting the rating load of the overload prevention mechanism 40 but also as part for holding the driving shaft 5 in the free rotation state, thereby saving the number of parts to that extent.

Also, between the first and second driving members 41 and 42 is provided the unidirectional rotation mechanism which, when the second driving member 42 rotates in the driving direction, makes the second driving member 42 freely rotatable with respect to the first driving member 41 and, when rotating in the non-driving direction, makes the second driving member 42 integrally rotatable with the first driving member 41. A plurality of engaging grooves 51 engageable with the engaging member 49 constituting the unidirectional rotation mechanism are provided, whereby, when the second driving member 42 is reversely rotated to reversely rotate the first driving member 41 to thereby carry out the lowering of chain or release of traction, the engaging member 49 is engaged with one of the engaging grooves 51 at a little angle without requiring a full rotation of the second driving member 42 and can be integral with the first driving member 41, whereby the lowering of chain or release of traction can quickly be started to that extent.

Although the invention has been described with reference to several different embodiments, these embodiments are merely exemplary and not limiting of the invention which is defined solely by the appended claims.

What is claimed is:

1. In a hoist and traction machine including a load sheave, a driving shaft for driving said load sheave and provided with a driven member, a driving member screw-threadedly engageable with said driving shaft, a mechanical brake arrangement interposed between said driving member and said driven member, an operating lever for operating the driving member in a normal direction or in a reverse direction and having an inner plate and a brake cover arranged to cover the mechanical brake arrangement, wherein the improvement comprising:

a) said inner plate of the operating lever having an aperture through which passes a portion of said driving member having a diameter smaller than that of the aperture, b) said brake cover has an aperture having a diameter substantially the same as that of said aperture of the inner plate of the operating lever, wherein there is provided c) a coupling means for coupling said operating lever with said brake cover for rotation relative thereto, said coupling means comprising c-1) a sleeve received in said apertures of the brake cover and inner plate and comprising a trunk on which margins of said apertures rest, a flange located at one longitudinal end of said trunk and extending radially outwardly of said trunk and a retaining groove located at an other longitudinal end of said trunk and extending circumferentially around said trunk, and c-2) a retaining ring fitted in said retaining groove, and wherein said sleeve is disposed such that said flange is engageable with an inner surface of said inner plate of the operating lever and said retaining ring is engageable with an inner surface of said brake cover, so that said operating lever is coupled to said brake cover to be rotatable relative thereto by inserting said sleeve from the aperture of the inner plate of said operating lever to the aperture of the brake cover and then fitting the retaining ring in the retaining groove.

* * * * *